US012012768B2

(12) United States Patent
Chan

(10) Patent No.: US 12,012,768 B2
(45) Date of Patent: Jun. 18, 2024

(54) SYSTEM AND METHOD FOR ROUND COLUMN CONSTRUCTION

(71) Applicant: OceanLink USA, Inc., Lodi, NJ (US)

(72) Inventor: Rizal S. Chan, Alpine, NJ (US)

(73) Assignee: OCEANLINK USA, INC., Lodi, NJ (US)

( * ) Notice: Subject to any disclaimer, the term of this patent is extended or adjusted under 35 U.S.C. 154(b) by 633 days.

(21) Appl. No.: 17/154,984

(22) Filed: Jan. 21, 2021

(65) Prior Publication Data

US 2022/0228380 A1 Jul. 21, 2022

(51) Int. Cl.

| | |
|---|---|
| ***E04G 13/02*** | (2006.01) |
| ***E04G 17/02*** | (2006.01) |
| ***E04G 17/14*** | (2006.01) |
| ***E04G 19/00*** | (2006.01) |

(52) U.S. Cl.

CPC ..... *E04G 13/021* (2013.01); *E04G 17/02* (2013.01); *E04G 17/14* (2013.01); *E04G 19/00* (2013.01)

(58) Field of Classification Search

CPC ..... E04G 13/021; E04G 17/02; E04G 17/04; E04G 17/14; E04G 19/00; E04G 21/1825

See application file for complete search history.

(56) References Cited

U.S. PATENT DOCUMENTS

| | | | | |
|---|---|---|---|---|
| 3,980,268 | A * | 9/1976 | Ellis | E04G 13/021 249/53 M |
| 3,990,672 | A * | 11/1976 | Buchanan | E04G 13/021 249/48 |
| 4,441,685 | A * | 4/1984 | Greeson | E04G 21/02 264/32 |
| 5,328,142 | A * | 7/1994 | Weekers | E04G 13/021 249/DIG. 2 |
| 2007/0175136 | A1* | 8/2007 | Knepp | E04G 13/02 52/294 |
| 2008/0072510 | A1* | 3/2008 | Wells | E04C 3/34 52/251 |
| 2008/0073481 | A1* | 3/2008 | Fornier | E04G 13/021 249/48 |
| 2012/0018942 | A1* | 1/2012 | Penza | E04G 13/021 248/351 |
| 2016/0009046 | A1* | 1/2016 | Villaescusa | B32B 27/12 428/36.1 |

* cited by examiner

*Primary Examiner* — Emmanuel S Luk
*Assistant Examiner* — Victoria Bartlett
(74) *Attorney, Agent, or Firm* — Mannava & Kang, P.C.

(57) ABSTRACT

An apparatus for forming a concrete column is disclosed. The apparatus may include a first column form half and a second column form half, which may be designed to be fitted together. The apparatus may also include a fastening system having at least one brace and a plurality of straps to fasten the first column form half with the second column form half to form a full column form. The full column form may then be filled with a poured concrete mixture, which when hardened or cured, may be a concrete column used in any number of structural or design applications.

20 Claims, 7 Drawing Sheets

200C

SYSTEM AND METHOD FOR ROUND COLUMN CONSTRUCTION

TECHNICAL FIELD

This patent application relates generally to a concrete construction systems and methods, and more specifically, to systems and methods for constructing a concrete column using a round column form.

BACKGROUND

Residential and commercial construction typically involves creation of vertical members, such as columns. These vertical members may transfer loads from slabs and beams by compression. Such compression may cause the vertical members to transfer load ultimately to the soil below. In other words, these vertical members are what allow a building or structure to stand. Most building or structure failure is the result of poor column construction.

Reinforced concrete construction of columns may be an important type of concrete element in a building, especially a multi-story building. However, the design and formation of these vertical elements may vary greatly. Things like shape, length, location, and understanding of various forces must be considered in their construction. With all these considerations, most conventional approaches may be complex, costly, and cumbersome.

Thus, a simple, inexpensive, reliable, and scalable systems and techniques to prepare and construct one or more columns or other similar vertical members in any building or structure may be imperative.

BRIEF DESCRIPTION OF DRAWINGS

Features of the present disclosure are illustrated by way of example and not limited in the following Figure(s), in which like numerals indicate like elements, in which.

DETAILED DESCRIPTION

Figure 1A:
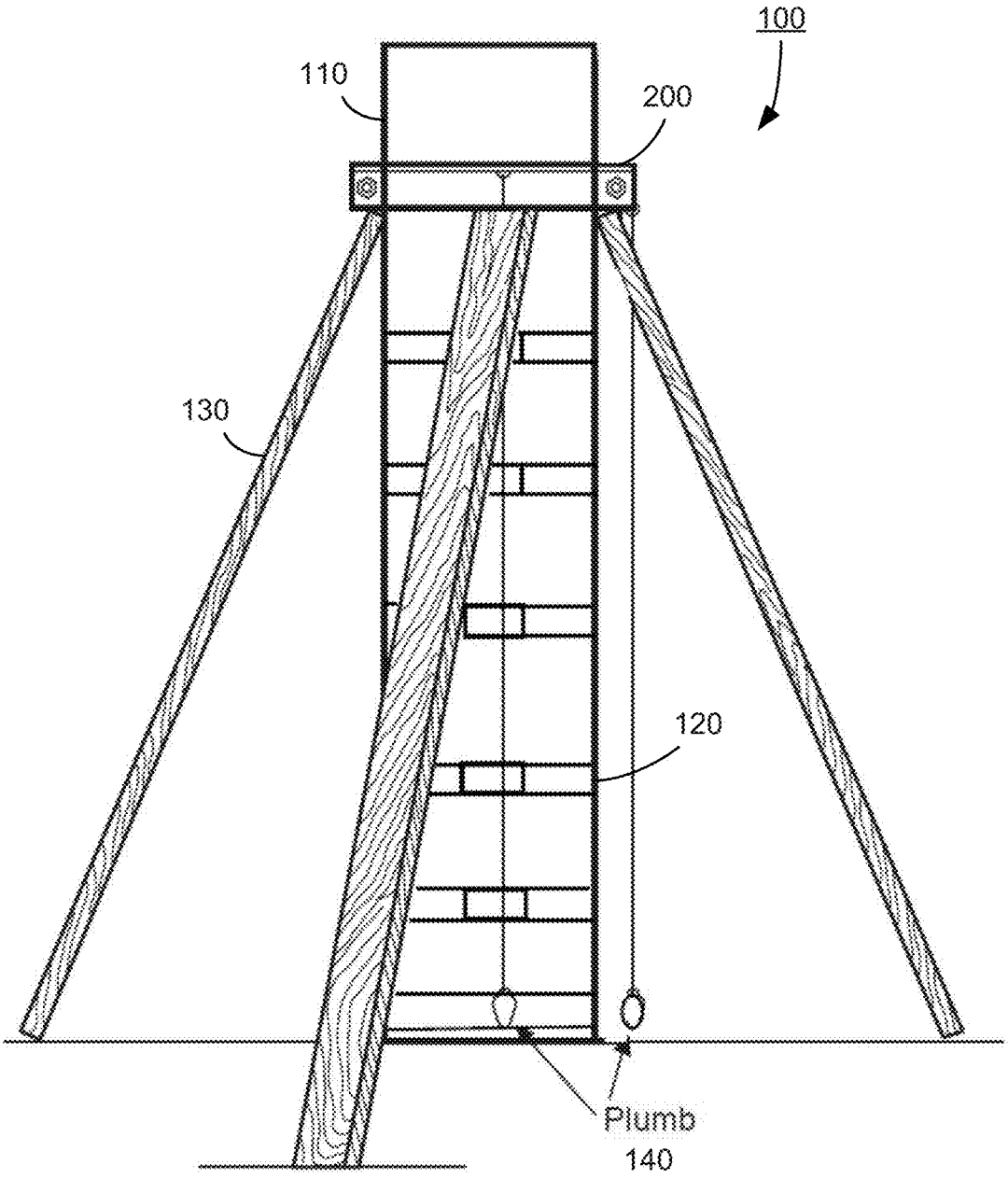
FIGS. 1A-1B illustrate a side view of a round column form, according to an example.

For simplicity and illustrative purposes, the present disclosure is described by referring mainly to examples and embodiments thereof. In the following description, numerous specific details are set forth in order to provide a thorough understanding of the present disclosure. It will be readily apparent, however, that the present disclosure may be practiced without limitation to these specific details. In other instances, some methods and structures readily understood by one of ordinary skill in the art have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

As described above, reinforced concrete construction of columns may be an important type of concrete element in a building, especially a multi-story building. However, the design and formation of these vertical elements may vary greatly. Things like shape, length, location, and understanding of various forces must be considered in their construction. With all these considerations, most conventional approaches may be complex, costly, and cumbersome.

There may be several stages involved in the construction of columns, especially concrete columns. These may include, but not limited to: (1) column layout; (2) column reinforcement; (3) column formwork; and (4) pouring concrete into column. Column layout may generally be a stage that is determined early on in the design process and may occur practically in field. Column layout, for example, may include drawing, marking, and/or using rope-line measurements to place and position various columns in accordance with architectural drawings or layouts. Pouring concrete may be a relatively simple stage, assuming column reinforcement and formwork are established and completed. Pouring concrete may generally involve mixing concrete (machine, ready-mix, or otherwise) and pumping the mixed concrete into the established concrete form. The systems and methods described herein may be directed generally to aspects of (2) column reinforcement and/or especially (3) column formwork.

The systems and methods, as described herein, may provide a two-piece column form that is innovative and novel, in some examples, the systems and methods described herein may provide round column construction using overlaid plywood with excellent surface durability and/or for mirror gloss finishes or other finish. In some examples, panel construction may include a three-part, high-density, overlay on hardwood, such as a poplar/birch mixed inner ply. In some examples, a two-step technique, which may involve bonding using an adhesive, such as phenolic glue, and laminated with paper (e.g., #100 film) on both sides may also be involved to provide round column form.

It should be appreciated that after hours of 95° C. high temperature pressurized with molded half round forms, half round columns may set and formed permanently. In some examples, edges may be trimmed, e.g., tongue and groove, and calibrated to fit the round column.

Benefits and advantages of the systems and methods described herein may include ease of use, installation, removal and/or transportation of elements. The column forms and associated elements for the systems and methods described herein may also be easily cut, designed with grooves or notches, which help ensure stable interconnections that prevent or reduce concrete leakage. In addition, the column forms and processing techniques described herein may generally incorporate plywood that is lightweight and easy to handle. In some examples, the column forms may be used in a stacking configuration, e.g., up to 30 feet without use of a crane or other similar machinery. These and other advantages will be apparent in the detailed description provided below.

Figure 1B:
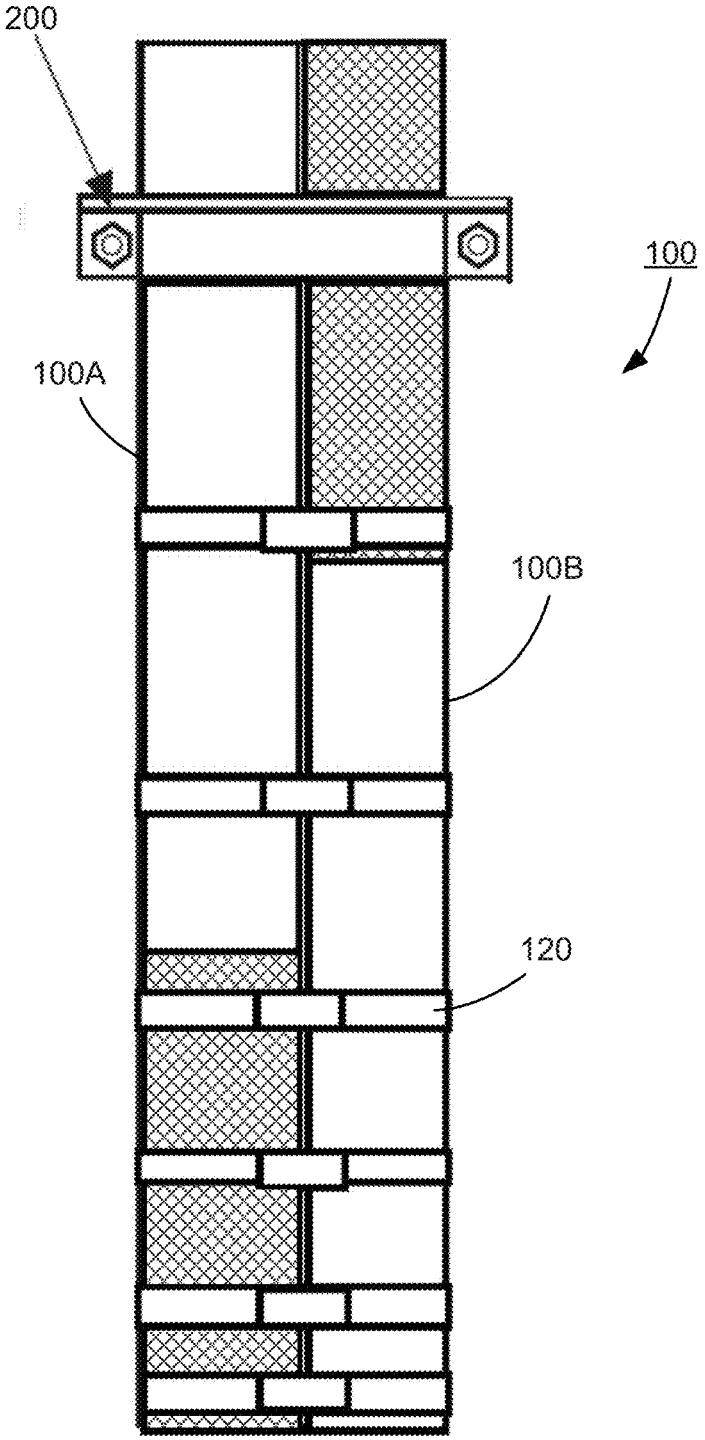

FIGS. 1A-1B illustrate a side view of a column form 100, according to an example. As shown in FIG. 1A, the column form 100 may be a round column form in a vertical position. In some examples, the column form 100 may be a two-piece round column form that is held together by at least one strap 120 and at least one brace element 200. The column form 100 may also be supported by one or more kickers 130. One or more plumbs 140 may also be used to help ensure the column is plumb or other similar vertical positioning. FIG. 1B illustrates the column form 100 of FIG. 1A without the kickers 130 or plumbs 140.

In some examples, the column form 100 may be a two-piece round column form, having a first form 100A and a second form 100B, as shown in FIG. 1B. The first form 100A and the second form 100B of the column form 100 may be positioned in an alternating fashion for greater scalability and column form construction, as described in more detail below. In some examples, the column form 100 may be constructed of any number of strong yet lightweight material. For example, the column form 100 may be made of high-density poplar or birch hardwood. In some examples, the polar/birch hardwood may be an inner ply with other components forming outer layers. Other materials may also be used, such as simulated wood, bamboo, engineered lumber or ply, composite wood, off strand board (OSB), or any other wood, wood-like, or pulp material.

In some examples, the column form 100 may be bonded with an adhesive, such as phenolic glue, with outer layers laminating the hardwood inner ply. The outer layers, for example, may be thin film paper, such as #100 film paper. It should be appreciated that high temperature exposure and pressurization (e.g., 95° C.), the column form 100 may be molded into half-round forms, which can then be set and permanently used for column formwork and related construction.

It should be appreciated that the edges of the column form 100 may be trimmed as necessary to help ensure proper shape, size, and/or dimension of the column form 100. In some examples, the trimming of the edges may also involve providing a tongue-and-groove to ensure secure fit of the two half-pieces during column formwork stages of construction.

During column formwork, the one or more kickers 130 may be used. These kickers 130 may be used to help secure to column form 100 with a slab (or ground) below. The brace element 200 and straps 120 may also be used to help retain and hold the column form 100 together. It should be appreciated that the brace element 200 may be used at a predetermined distance from the top of the column form 100, as shown. In some examples, this predetermined distance may be 12 inches from the top of the column form 100. Details of the brace element 200 will be described in more detail with respect for FIGS. 2A-2C. Altogether, the brace element 200, the straps 120, and kickers 130 may be used to hold the column form 100 in a desired vertical position for concrete filling.

The strap 130 may include a 2-inch (or other dimension) strap and a fastener. In some examples, the strap 130 may be made of steel, or other suitable material, such as a nylon, polyester, wood, rubber, string, or pliable material that can be used to perform a similar feature. In some examples, the fastener may be any type of buckle, latch, or other similar fastening or securing mechanism to keep the strap 130 in place. As shown in FIGS. 1A-1B, the straps 130 and brace element 200 may be place strategically at certain points around the column form 100.

Although the systems and methods described herein are directed to round column forms with typical dimensions, it should be appreciated that there may or may not be any limits on the size, shape, width, length, height, material, or other dimensions for the column form 100 and associated elements, such as the strap 120, the kicker 130, etc. That said, in some examples, a diameter of the column form 100 may be in the 12- to 72-inch range. In some examples, the length (or height) of the column form 100 may be in the 4 to 20 feet range. In some examples, the plywood thickness may be 9 to 18 mm or ⅜ to ¾ inch (for a column form 100 having a 12- to 30-inch diameter) or 22 to 35 mm or ⅞ to 1⅜ inch (for a column form 100 having a 32- to 72-inch diameter). Although the sizes and ranges listed herein may be customary sizes in commercial or multi-story construction, other various sizes, dimensions, ranges, shapes, or values may also be provided for the column form 100.

It should be appreciated that a release be applied to the interior of the column form prior to each use. The release may be any release agent, such as any number or various of oils, jellies, or other agents. These may include, but not limited to castor oil, petroleum jelly, grease, wax, and/or other nonstick release agent. Application of the form release may help extend the number of uses of the column form 100 for column formwork and filling. In some examples, use of a release agent may extend the life of the life (number of uses) of the column form 100 by 50% or more.

Figure 2A:
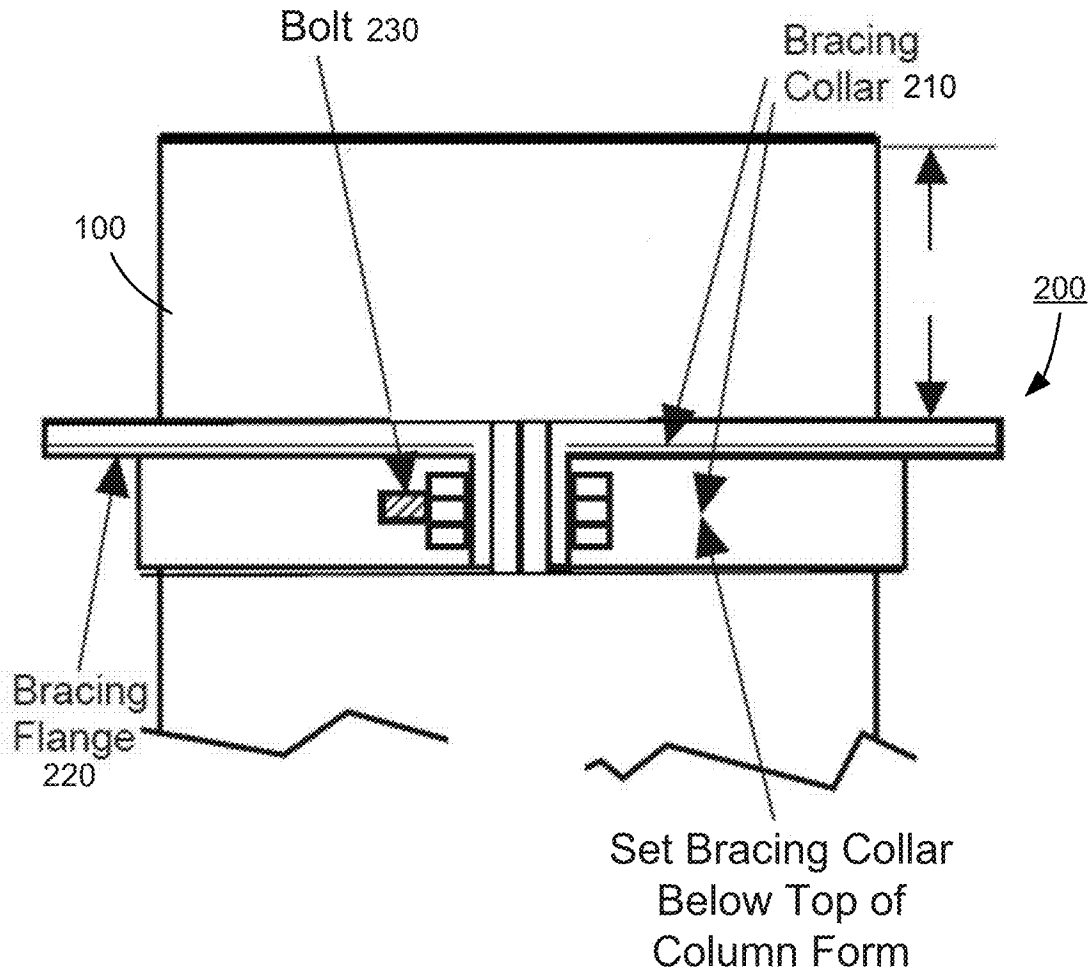
FIGS. 2A-2C illustrate various views of a brace for a round column form, according to an example.
Figure 2B:
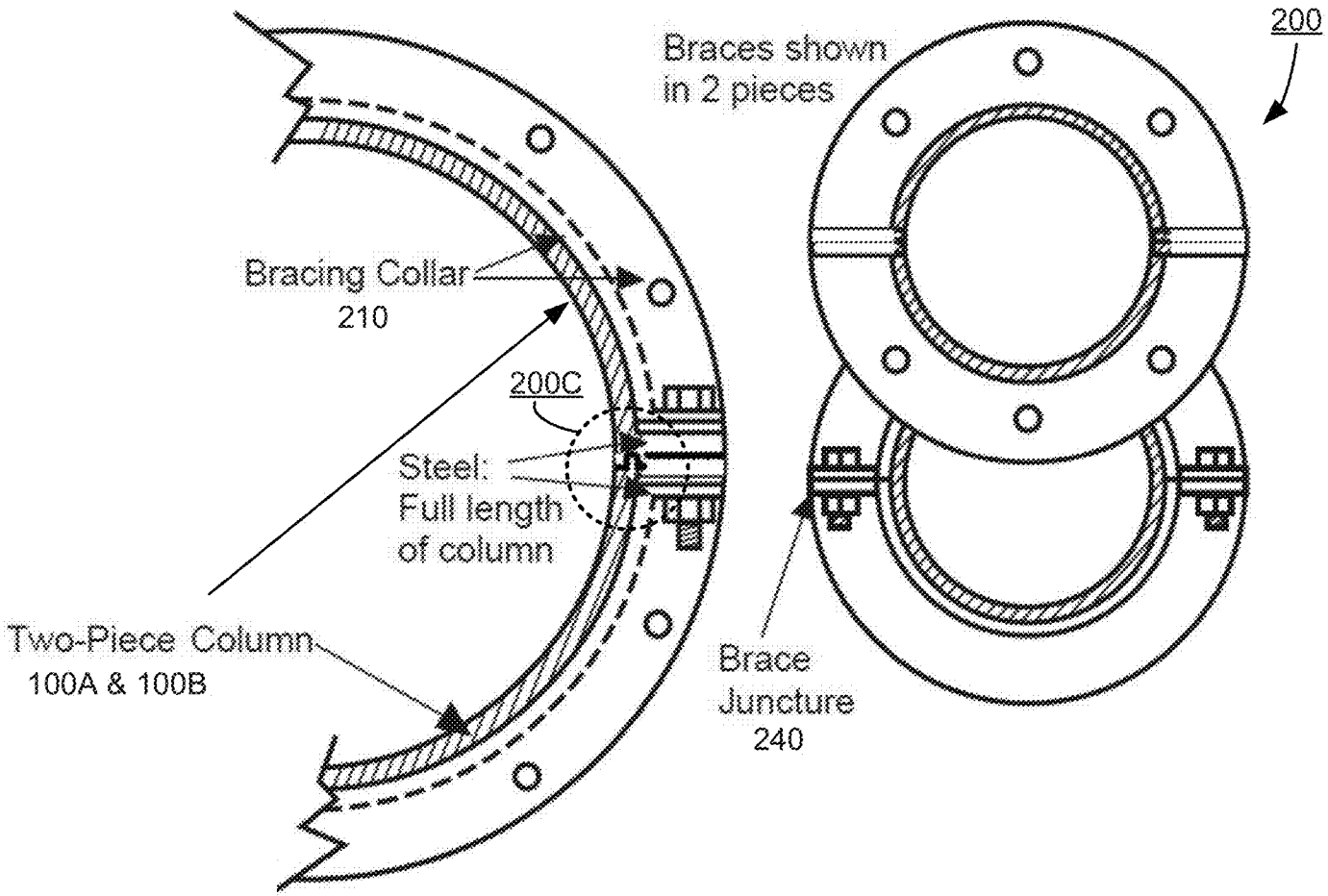
Figure 2C:
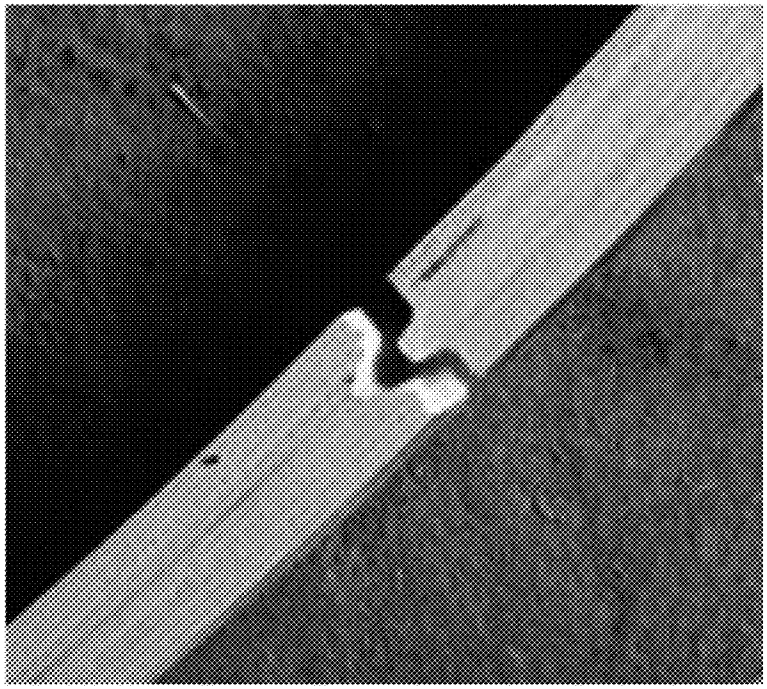

FIGS. 2A-2C illustrate various views of a brace element 200 for a column form 100, according to an example. As shown in FIG. 2A, the brace element 200 may include a bracing collar 210, a bracing flange 220, and a fastener (e.g., bolt) 230. In some examples, it should be appreciated that the bracing collar 210 may be position approximately 12 inches (or other predetermined distance depending on an overall height of the desired concrete column or form) below the top of the column form 100.

FIG. 2B illustrates a top and bottom views of the brace element 200. As shown, the brace element 200 may hold the first form 100A and the second form 200A of the two-piece column 100 together. In some examples, the bracing collar 210 may be made of steel (or other similar material) with a fastener (e.g., bolt) 230 connecting the brace element 200 at one or more brace junctures 240, as shown. In some examples, the brace collar 210 may have alignment holes to help with alignment of the brace element 200. It should be appreciated that in some examples, the first form 100A and the second form 100B of the column form may be fitted together with a tongue and groove type configuration 200C, as shown. FIG. 2C illustrates a tongue and groove type configuration 200C of the plywood used in the column form 100 with greater magnification. Although a tongue and groove type configuration 200C is shown, it should be appreciated that any number of fastening designs may be used as well. These may include any male-to-female connection or configuration that uses any type of fitted form factor.

Figure 3B:
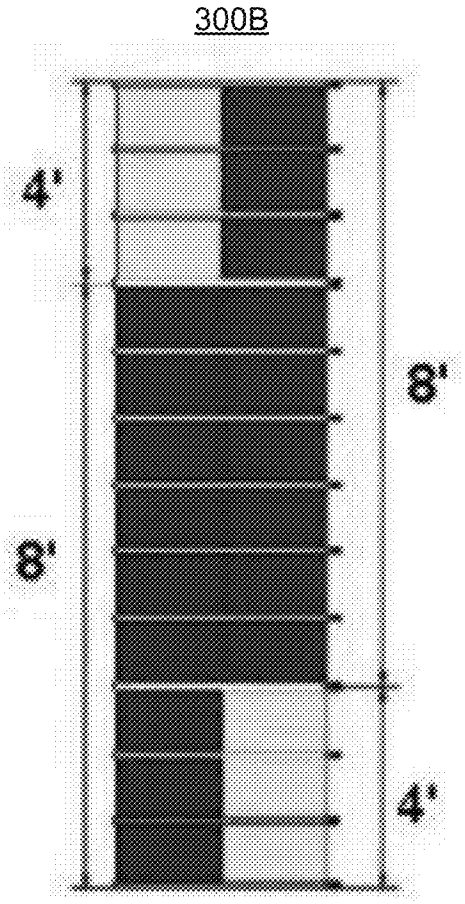
FIGS. 3A-3B illustrate applications of a round column form, according to an example.
Figure 3A:
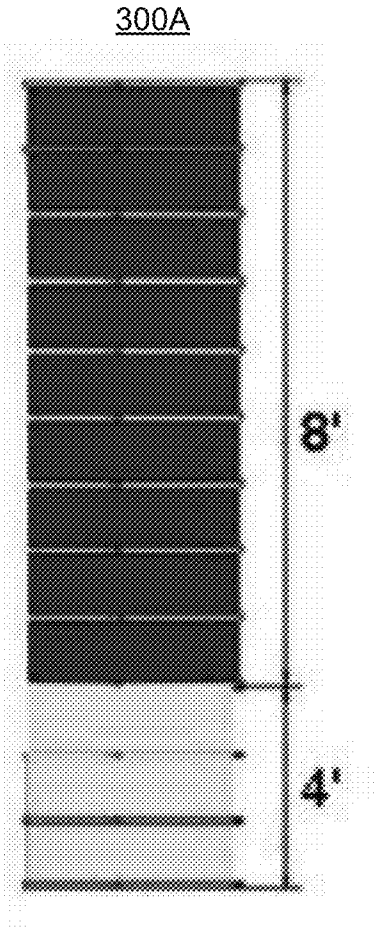

FIGS. 3A-3B illustrate applications 300A-300B of a round column form, according to an example. As shown in FIG. 3A, two half-round columns 100A and 100B may be set to form watertight by tightening the steel straps set at matching intervals according to the diameter and height of columns, as described herein. As shown in FIG. 3B, two half-round columns 100A and 100B may also be set to form watertight by tightening the steel straps set at different or alternating intervals according to the diameter and height of columns, as described herein. In this application, the first form 100A and the second form 100B may be positioned in an alternating fashion to provide greater scalability and column form construction.

In some examples, the lowermost or bottom ($1^{st}$) strap may be placed at approximately ⅝" from the floor/base. The height may vary, but the intention to provide a little space may simply be to avoid the concrete to adhere to the form, and to be ready for the next pour. It should be appreciated that the subsequent straps may be required to increase ⅓ quantity at the bottom portion, at every additional 10' height of columns, as outlined in TABLE 1 below.

TABLE 1

| Column Diameter (inches) | Space On Center (o.c.) |
|---|---|
| 12"~16" | 16"-24" o.c. |
| 18"~22" | 12"-20" o.c. |
| 24"~28" | 10"-18" o.c. |
| 30"~34" | 8"-12" o.c. |
| 36"~42" | 6"-10" o.c. |
| 44"~48" | 3"-6" o.c. |
| 60"~72" | 2"-3" o.c. |

This may help with weight and load of concrete being poured into the forms and to help retain uniformity throughout the entire column, no matter how tall it is. It should be appreciated that the term "on-center," sometimes often abbreviated "OC" or "o.c.,"" may be used in construction drawings, architectural plans, and woodworking designs. The term may indicate a relative dimension, and in this case, may refer to a distance between a center of one framing member to a center of a next member. In other words, the aforementioned spacings (in o.c.) may refer to the spacing between straps.

In an example, the systems and methods may follow column specifications as outlined below in TABLE 2.

TABLE 2

| Column Diameter | Length Up To | Approx. Weight Per Lineal Ft. (Half Round) | Approx. Volume of Concrete Per Lineal Ft. |
|---|---|---|---|
| 12" | 30' | 2.55 lbs | 0.8 cu-ft |
| 14" | 30' | 2.9 lbs | 1.0 cu-ft |
| 16" | 30' | 3.2 lbs | 1.4 cu-ft |
| 18" | 30' | 3.3 lbs | 1.8 cu-ft |
| 20" | 30' | 3.75 lbs | 2.2 cu-ft |
| 22" | 30' | 4.35 lbs | 2.6 cu-ft |
| 24" | 30' | 6 lbs | 3.1 cu-ft |
| 26" | 30' | 6.6 lbs | 3.6 cu-ft |
| 28" | 30' | 7.2 lbs | 4.2 cu-ft |
| 30" | 30' | 7.8 lbs | 4.9 cu-ft |
| 32" | 30' | 8.3 lbs | 5.5 cu-ft |
| 34" | 30' | 8.9 lbs | 6.3 cu-ft |
| 36" | 30' | 9.5 lbs | 7.0 cu-ft |
| 38" | 30' | 10.1 lbs | 7.9 cu-ft |
| 40" | 30' | 10.7 lbs | 8.7 cu-ft |
| 42" | 30' | 11.3 lbs | 9.6 cu-ft |
| 44" | 30' | 11.9 lbs | 10.6 cu-ft |
| 46" | 30' | 12.5 lbs | 11.5 cu-ft |
| 48" | 30' | 13.1 lbs | 12.6 cu-ft |

In some examples, there may be recommendations for approximate maximum rate of pouring of concrete into the column form, as shown in the specifications outlined below in TABLE 3.

TABLE 3

| Approx. Maximum Rate of Pour | |
|---|---|
| At 90° F. | 20 feet per hour |
| At 80° F. | 18 feet per hour |
| At 70° F. | 16 feet per hour |
| At 60° F. | 14 feet per hour |
| At 50° F. | 11 feet per hour |
| At 40° F. | 9 feet per hour |

Figure 4:
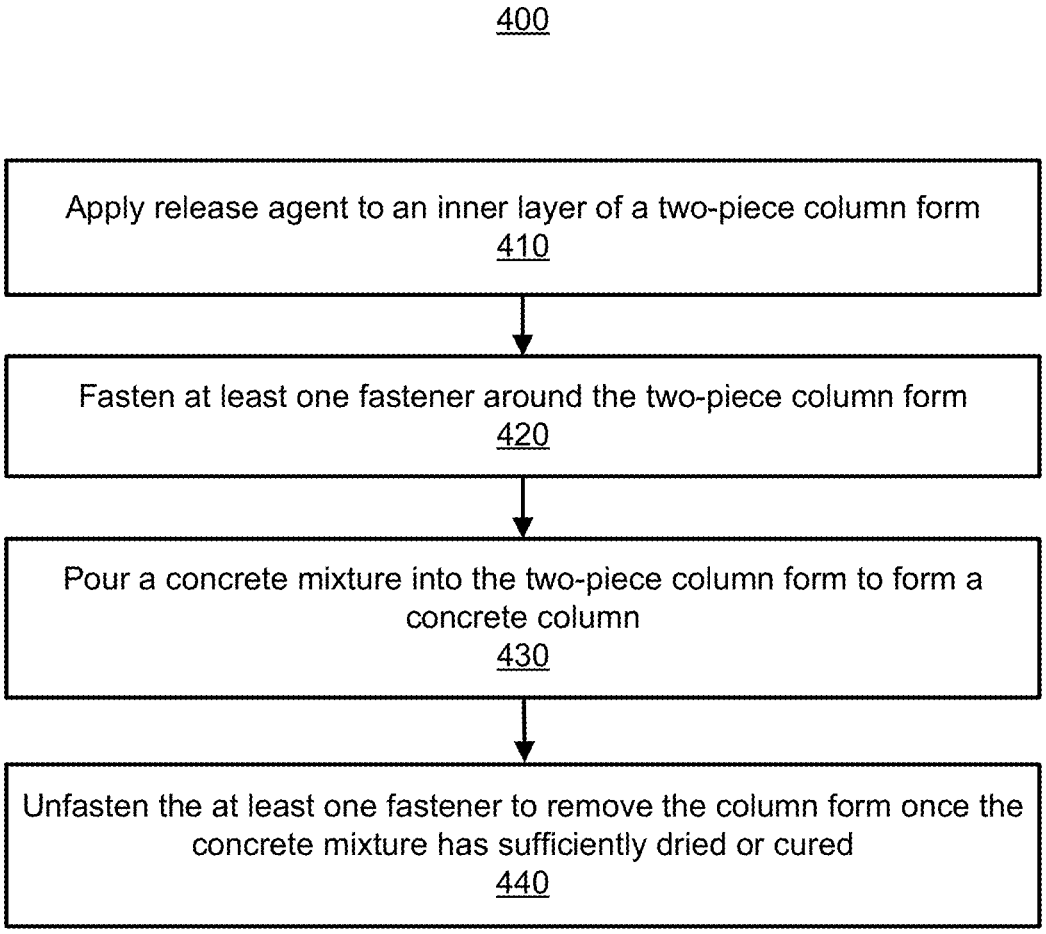
FIG. 4 illustrates a method of forming a concrete column using a column form, according to an example.

FIG. 4 illustrates a method 400 for using the column form, according to an example. The method 400 is provided by way of example, as there may be a variety of ways to carry out the method described herein. Although the method 400 is primarily described as being performed using the column form 100 as shown in FIG. 1, the method 400 may be executed or otherwise performed by other systems or apparatuses, or a combination of systems and apparatuses. Each block shown in FIG. 4 may further represent one or more processes, methods, or subroutines, and one or more of the blocks may include machine-readable instructions stored on a non-transitory computer-readable medium and executed by a processor or other type of processing circuit (in any number of devices or related machinery) to perform one or more operations described herein.

At 410, apply a release agent to an inner layer of a column form. In some examples, the column form may be a two-piece column form, as described herein. In some examples, the release agent may be any number of oils, jellies, or other agents, as described herein.

At 420, fasten at least one fastener around the column form. In some examples, the at least one fastener may help fit the two pieces of the column form, in accordance with examples described herein. The fastener, in some examples, may be a system of at least one brace and/or at least one strap made of various materials described herein. The fastener system may also include any number of kickers (e.g., attached to the brace) to provide stability to the column form. In some examples, the two-piece column form may be fastened in any by the at least one strap in an alternative At 430, a concrete mixture may be poured into the concrete form to form a concrete column. As described herein, pouring concrete may generally involve mixing concrete (machine, ready-mix, or otherwise) and pumping the mixed concrete into the concrete form. It should be appreciated that any number of concrete mixtures may be used depending on specific application or use. For example, these may include various concrete mix/liquid/aggregate ratios. Fine, medium, or coarse aggregates may be used depending on application or use as well.

In some examples, paper linings (e.g., spiral paper tubes) may be used to help form concrete columns, piers, and/or footings. These paper linings may be customizable. For example, they may have 6" to 60" diameters and be configured for cut-to-length sizing using any number of basic cutting tools. In some examples, the paper linings may be made of recycled paperboard and include rain-resistant technology to keep rain or other source of moisture from impacting any concrete pour. Use of paper linings may minimize or eliminate need for cleaning, reassembly, or return freight costs. It may also provide setting and pouring multiple columns in a short timespan or overlapping time spans.

At 440, unfasten the at least one fastener to remove the column form. This may be done once the concrete mixture has sufficiently dried or cured. In some examples, depending on the concrete mixture, this may take a relatively short time with little manual labor. For example, it may take 2 people approximately 6-8 hours to provide the formwork and concrete pour.

It should be appreciated that the systems and methods described herein may provide any number of technical advantages. These may include ease of use, installation, removal and/or transportation of elements. The column forms and associated elements for the systems and methods described herein may also be easily cut, designed with grooves or notches, which help ensure stable interconnections that prevent or reduce concrete leakage. In addition, the column forms and processing techniques described herein may generally incorporate plywood that is lightweight and easy to handle. In some examples, the column forms may be used in a stacking configuration, e.g., up to 30 feet without use of a crane or other similar machinery. Accordingly, the column forms described herein may provide reduced construction time, greater consistency in quality column construction, reproducibility and scalability, and less required man-power, all of which may translate to higher construction efficiencies, reliability, strength, and manageability.

What has been described and illustrated herein are examples of the disclosure along with some variations. The terms, descriptions, and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

The invention claimed is:

1. An apparatus, comprising: a first column form half, a second column form half, and a fastening system comprising at least one brace and a plurality of straps to fasten the first column form half with the second column form half to form a full column form, wherein each of the first column form half and the second column form half is a single wall component with edges having a tongue-and-groove fitted configuration on the edges for the edges of the first column form half and the edges of the second column form half to fit into one another when the first column form half and the second column form half are coupled and fastened by the at least one brace and the plurality of straps, and wherein the plurality of straps are placed on the full column form at spacing intervals that are determined based on a diameter of the full column form, in which a larger the diameter of the full column form, a smaller the space intervals between the plurality of straps, including: for the diameter of the full column form being between 12 and 16 inches, the spacing intervals between the plurality of straps are determined to be between 16 and 24 inches, and for the diameter of the full column form being between 18 and 22 inches, spacing intervals between the plurality of straps are determined to be between 12 and 20 inches.

2. The apparatus of claim 1, wherein the first column form half and the second column form half have inner surfaces that are coated with a release agent.

3. The apparatus of claim 2, wherein the release agent comprises at least one of an oil, a jelly, a grease, a wax, or nonstick substance.

4. The apparatus of claim 1, further comprising at least one kicker to provide stability to the full column form when in a vertical configuration, wherein the at least one kicker is connectable to the at least one brace.

5. The apparatus of claim 1, further comprising at least one plumb to provide vertical alignment for the full column form, wherein the at least one plumb is connectable to the at least one brace.

6. The apparatus of claim 1, wherein the first column form half is fastened with the second column form half in an alternating fashion.

7. The apparatus of claim 1, wherein the first column form half and the second column form half are made of at least a plywood or paper.

8. The apparatus of claim 1, wherein an adhesive is used to help couple the first column form half with the second column form half to form the full column form.

9. The apparatus of claim 1, wherein the first column form half and the second column form half have inner surfaces that are laminated with a paper lining.

10. The apparatus of claim 1, wherein the full column form retains a concrete mixture to form a concrete column.

11. A method of forming a concrete column, the method comprising: applying a release agent to inner surfaces of a first column form half and a second column form half; using a fastening system comprising at least one brace and a plurality of straps to fasten the first column form half with the second column form half to form a full column form, wherein the plurality of straps are placed on the full column form formed from the first column form half and the second column form half at spacing intervals that are determined based on a diameter of the full column form, in which a larger the diameter of the full column form, a smaller the space intervals between the plurality of straps, including: for the diameter of the full column form being between 12 and 16 inches, the spacing intervals between the plurality of straps are determined to be between 16 and 24 inches, and for the diameter of the full column form being between 18 and 22 inches, the spacing intervals between the plurality of straps are determined to be between 12 and 20 inches, and wherein each of the first column form half and the second column form half is a single wall component with edges having a tongue-and-groove fitted configuration on the edges for the edges of the first column form half and the edges of the second column form half to fit into one another when the first column form half and the second column form half are coupled and fastened by the at least one brace and the plurality of straps; and pouring a concrete mixture into the full column form to form the concrete column.

12. The method of claim 11, further comprising unfastening the fastening system and removing the first column form half and the second column form half once the concrete mixture is sufficiently cured or solidified.

13. The method of claim 11, further comprising:

attaching at least one kicker to the at least one brace to provide stability to the full column form when the full column form is in a vertical configuration.

14. The method of claim 11, further comprising:

attaching at least one plumb to the at least one brace to provide vertical alignment for the full column form.

15. The method of claim 11, wherein the first column form half is fastened with the second column form half in an alternating fashion.

16. The method of claim 11, wherein the first column form half and the second column form half are made of at least a plywood or paper.

17. The method of claim 11, further comprising:

placing an adhesive on the first column form half and the second column form half to help connect the first column form half with the second column form half to form the full column form.

18. The method of claim 11, wherein the release agent comprises at least one of an oil, a jelly, a grease, a wax, or nonstick substance.

19. The method of claim 11, further comprising:

laminating the inner surfaces of the first column form half and the second column form half with a paper lining.

20. A concrete column form apparatus, comprising: a first column form half coated with a first release agent on a first inner surface; a second column form half coated with a second release agent on a second inner surface; and a fastening system comprising at least one brace and a plurality of straps to fasten the first column form half with the second column form half to form a full column form, wherein: each of the first column form half and the second column form half is a single wall component with edges having a tongue-and-groove configuration on the edges for the edges of the first column form half and the edges of the second column form half to fit into one another when the first column form half and the second column form half are coupled and fastened by the at least one brace and the plurality of straps; the plurality of straps are placed on the full column form at spacing intervals that are determined based on a diameter of the full column form, in which a larger the diameter of the full column form, a smaller the space intervals between the plurality of straps, including: for the diameter of the full column form being between 12 and 16 inches, the spacing intervals between the plurality of straps are determined to be between 16 and 24 inches, and for the diameter of the full column form being between 18 and 22 inches, the spacing intervals between the plurality of straps are determined to be between 12 and 20 inches; and the first column form half and the second column form half each have predetermined identifiers for placement of the at least one brace and the plurality of straps of the fastening system.

* * * * *